US005964215A

United States Patent [19]

Cnossen

[11] Patent Number: 5,964,215

[45] Date of Patent: Oct. 12, 1999

[54] HEATING INSTALLATION WITH CLOSED LIQUID CIRCUIT

[76] Inventor: Jan Henk Cnossen, Spoarleane 23, NL-8723 EV Koudum, Netherlands

[21] Appl. No.: 08/945,207

[22] PCT Filed: Apr. 22, 1996

[86] PCT No.: PCT/NL96/00175

§ 371 Date: Jan. 27, 1998

§ 102(e) Date: Jan. 27, 1998

[87] PCT Pub. No.: WO96/33372

PCT Pub. Date: Oct. 24, 1996

[30] Foreign Application Priority Data

Apr. 21, 1995 [NL] Netherlands ..... 1000202

[51] Int. Cl.[6] ..... A47J 27/00

[52] U.S. Cl. ..... 126/373; 126/344; 237/7; 237/66

[58] Field of Search ..... 237/8 K, 7, 66; 126/373, 344

[56] References Cited

FOREIGN PATENT DOCUMENTS 0 543 285 5/1993 European Pat. Off. .
2 088 884 1/1972 France .

*Primary Examiner*—Henry Bennet
*Assistant Examiner*—Derek S. Boles
*Attorney, Agent, or Firm*—Evenson, McKeown, Edwards & Lenahan P.L.L.C.

[57] ABSTRACT

The invention relates to a heating installation comprising a closed liquid circuit which is under pressure during operation, in which are incorporated a heating boiler in which heat is supplied to a liquid circulating in the circuit and heat-generating means such as radiators and/or convectors, further comprising a pressureless liquid reservoir connectable by valve means to the circuit, which valve means are mechanical valve means controlled by the pressure in the circuit.

3 Claims, 4 Drawing Sheets

HEATING INSTALLATION WITH CLOSED LIQUID CIRCUIT

The invention relates to a heating installation of the type which operates with a closed liquid circuit which is under pressure during operation. Incorporated on the one hand in the liquid circuit is a heating boiler in which heat is supplied to the liquid circulating in the circuit. Incorporated on the other hand in the liquid circuit are radiators and/or convectors by means of which heat is generated from the liquid to spaces for heating. Instead of or in addition to convectors and radiators an air transporting system can be used.

Installations of this type comprise a liquid reservoir in which is accomodated the extra volume of liquid resulting from expansion caused by heating of the liquid. When the liquid in the liquid circuit cools, liquid is carried from the reservoir back into the circuit again to compensate the volume decrease due to this cooling.

A heating installation of this type is described in the international patent application PCT/NL95/00034. In the heating installation described in this application the liquid reservoir is pressureless and liquid can be carried out of the reservoir into the pressurized system by means of a pump.

The present application relates to a further developed embodiment of the heating installation known from the stated international patent application.

Figure 1:
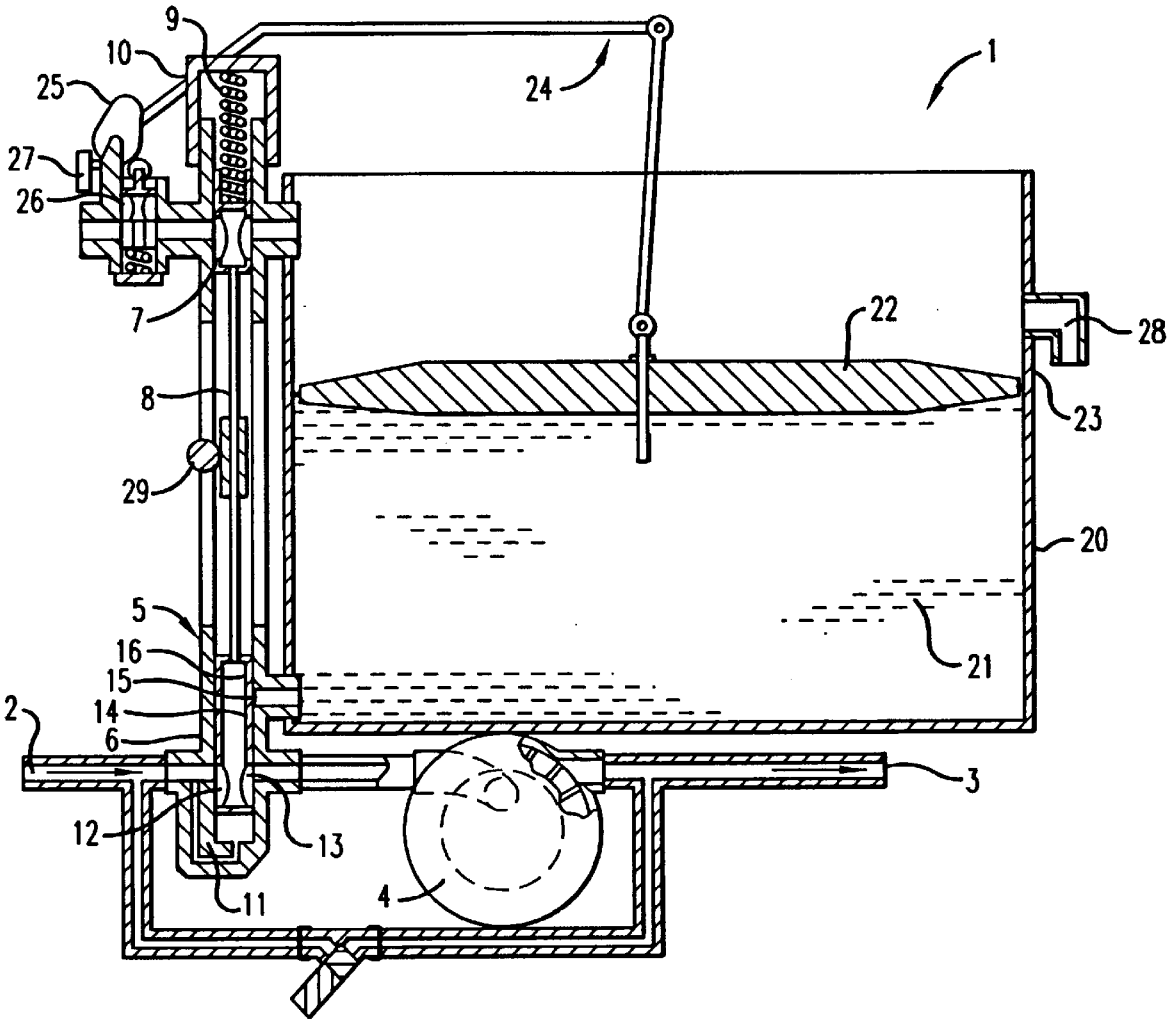
FIG. 1 shows schematically a preferred embodiment of the installation according to the invention.

Of the heating installation 1 as depicted schematically in FIG. 1 only that part is shown which relates to the feeding and draining of the central heating liquid, normally water.

The heating water circuit is connected at 2 and 3. For purposes of the description of the system shown in FIG. 1 the connection 2 is deemed the inlet of this system and connection 3 the outlet.

Accommodated between inlet 2 and outlet 3 is a pump 4 which serves during normal operation to keep the heating water in circulation but which moreover serves as replenishing pump in a manner to be further described.

In the pipe between inlet 2 and outlet 3 a valve system 5 is arranged on the inlet side of pump 4. In the embodiment shown this valve system 5 comprises a feed/drain valve 6 which is connected via a rod 8 to a blocking valve 7 which is loaded in downward sense by a spring 9. The spring 9 rests against a screw cap 10. By rotating screw cap 10 the tension of spring 9 can be adjusted and therewith the force with which the system formed from the valve piston 7, rod 8 and valve piston 6 is pressed downward.

The pressure of the heating water in the inlet 2 acts counter to the force of this spring 9. This pressure acts via the channel 11 on the bottom surface of the piston of valve 6.

In the normal operating situation shown in FIG. 1 the force of spring 9 is in balance with the force exerted by the liquid such that an inlet port 12 and an outlet port 13 of the piston of valve 6 forms an open connection in the inlet pipe 2 to the pump 4.

Figure 2:
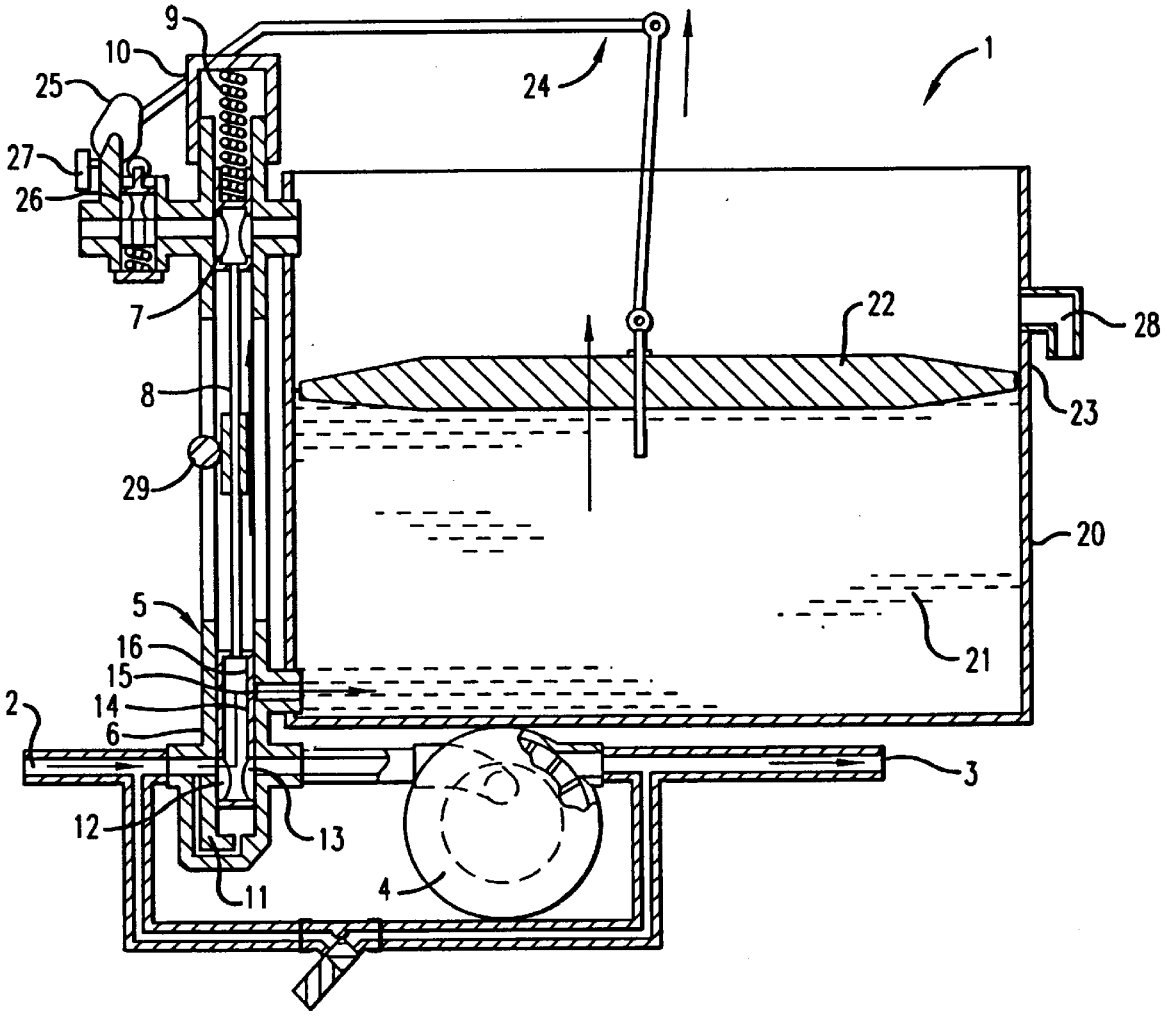
FIGS. 2–4 show three operational states of the installation of FIG. 1.

FIG. 2 shows the situation when the pressure in the circuit rises too high and excess heating water must therefore be drained in order to return the pressure to the normal operating value.

When the pressure increases the piston 6 will be pressed upward counter to the force of spring 9 until a drain port 14 comes to lie opposite a channel 15 to a reservoir 20. The excess liquid can flow into the reservoir 20 via this drain port 14 and channel 15. As soon as the pressure has fallen sufficiently, the piston of valve 6 will then be moved so far downward again that the drain port 14 is closed. This then provides readjustment to the situation shown in FIG. 1.

Thus collected in reservoir 20 is a quantity of liquid 21 which is under a markedly lower pressure, i.e. under atmospheric pressure.

If gases are dissolved in the heating water drained to reservoir 20 these will, as a result or the lower pressure in reservoir 20, rapidly be released from solution and escape into the tank 20. The supply of liquid 21 is covered in reservoir 20 with a float 22 which seals via flexible seals 23 against the wall or reservoir 20. These seals 23 are such that released gases can escape. Evaporation of the liquid 21 is however almost entirely prevented.

Figure 3:
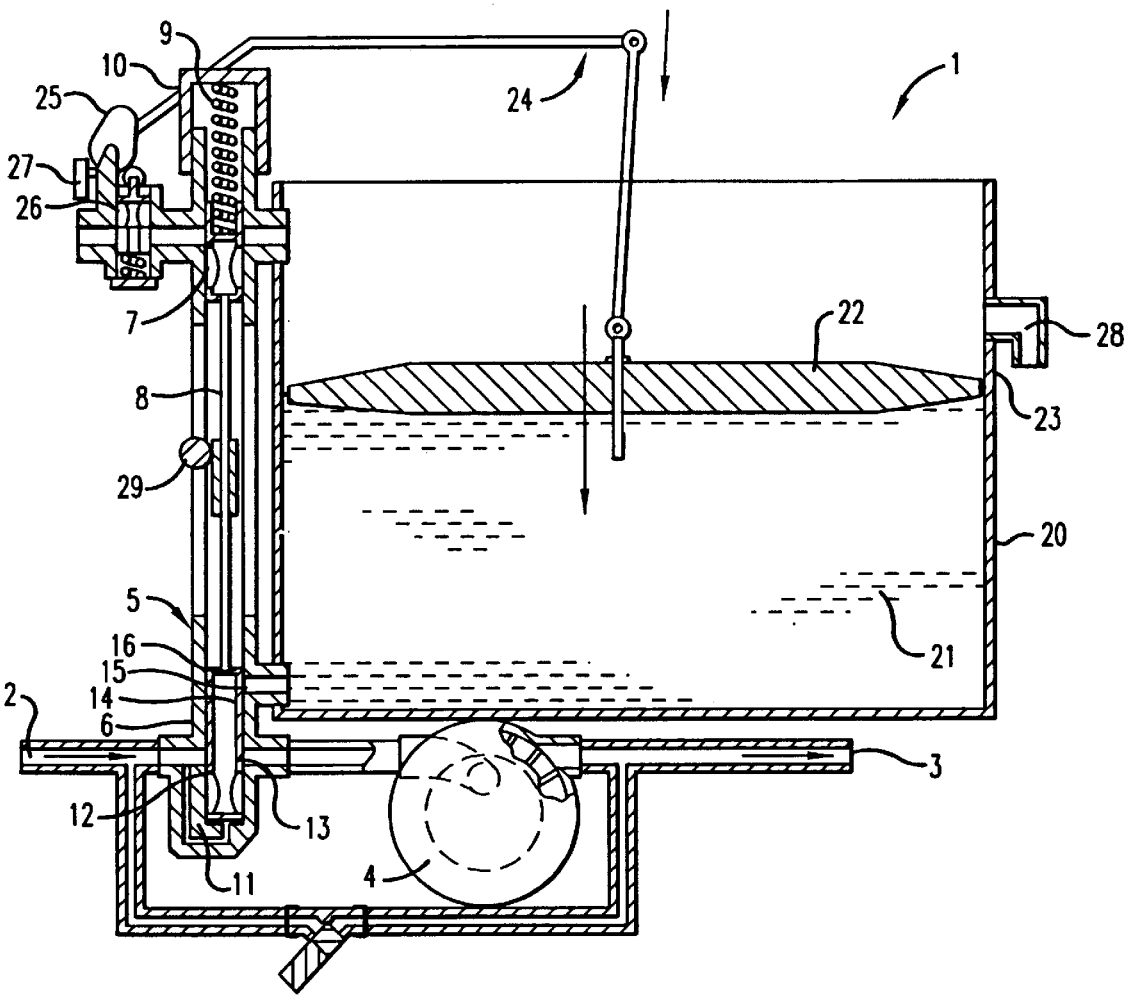

FIG. 3 shows the situation when the pressure in the heating system falls too much. In that case the system consisting of the piston of valve 6, connecting rod 8 and the piston of blocking valve 7 will move downward under the influence of spring 9. In the situation shown in FIG. 3 the piston of valve 6 has moved so far downward that the inlet port 12 has closed the connection with the inlet pipe 2. The outlet port 13 covers a greater distance and is still open in this situation. The feed port 16 has simultaneously come to lie in line with the channel 15 leading to reservoir 20. The pumps 4 now draws liquid 21 out of reservoir 20 via channel 15, feed port 16 and outlet port 13 of valve 6. This drawing of liquid from reservoir 20 and pressing thereof into the heating system via outlet 3 continues until the pressure at the inlet pipe 2 has risen sufficiently to press the piston of valve 6 upward counter to the force of spring 9 in order to close feed port 16 and open inlet port 12.

It is self-evident that the pump 4 must be designed or chosen such that in the replenishing situation just described with reference to FIG. 3 it can build up sufficient pressure to be able to press the pressureless water from reservoir 20 to at least the operating pressure in the heating system.

During heating and cooling of the heating water circuit connected to inlet 2 and outlet 3 a quantity of heating water will thus in each case be drained to the reservoir 20 respectively pumped out of this reservoir 20 into the system. Due to the above described degassing action resulting from the pressure decrease, the heating water will be fully degassed very rapidly.

Figure 4:
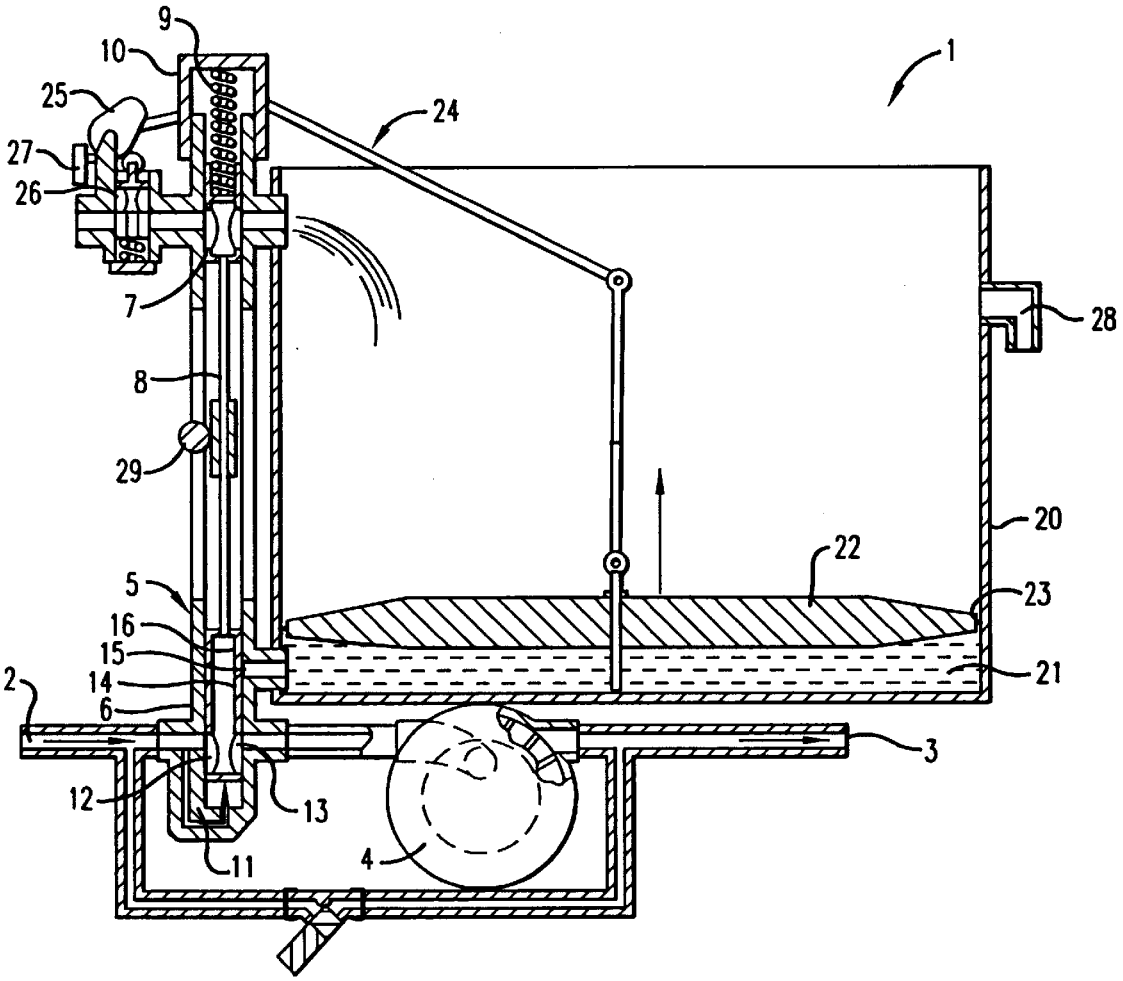

When the supply of replenishing water 21 in reservoir 20 has decreased too much, for instance due to the very stall leakages practically always present in the system, the float 22 will fall to the position shown in FIG. 4. The valve 26 is herein pressed open via the rod transmission 24 and cam 25, which valve is connected to a source of liquid under pressure, in particular the drinking water supply system. By pressing open valve 26 water is fed into the reservoir 20 until the float 22 has once again been moved so far upward that valve 26 closes.

The blocking valve 7 prevents water from for instance the drinking water supply also being fed into the reservoir 20 when the pressure in the system is low. As shown in FIG. 3, the blocking valve 7 closes the supply via valve 26 to reservoir 20 when the pressure in the heating system is low. Therefore, even when in that case the float 22 is in a low position, no water will be added. This function is particularly important when a leakage of some size occurs in the heating system. The pressure will then fall so far that the valve system 5 assumes the position shown in FIG. 3. The pump 4 will pump the available water 21 out of reservoir 20 into the system. In the case of a leakage the pressure will hereby not rise. The pumped-in water will disappear from the system via the leak. Valve system 5 thus remains in the position shown in FIG. 3, wherein the supply of fresh water from the drinking water supply in blocked by the blocking valve 7.

Also co-acting with cam 25 is a pump switch 27 which can be adjusted such that the pump 4 is switched off as soon as float 22 falls below a minimum level lying below the level at which valve 26 in opened during normal operation. Pump switch 27 is then only activated to switch off pump 4 when the level in reservoir 20 falls in the case of low pressure in the system, i.e. in particular therefore when there is leakage in the system.

Reservoir 20 is further provided with an overflow 28 which prevents water 21 being able to rise in reservoir 20 to a level at the height of the drinking water supply.

Engaging onto the connecting rod is a friction-damping member which prevents the system reciprocating between the positions of FIG. 2 and 3. This damping can easily adjustable by exerting a greater or lesser clamping force on rod 8 by means of an adjusting screw.

I claim:

1. A heating installation comprising a closed liquid circuit which is under pressure during operation, comprising:

a heating boiler in which heat is supplied to a liquid circulating in the circuit;

heat-generating means;

a pressureless liquid reservoir connectable by a valve system to the circuit, which valve system is controlled by the pressure in the circuit; and a channel between said reservoir and said valve system;

wherein said valve system comprises a feed/drain valve comprising a valve element having a drain port and a feed port, said valve element being movable between a first position wherein said drain port lies in line with said channel when the pressure is high and a second position wherein said feed port lies in line with said channel when the pressure is low.

2. The heating installation according to claim 1, wherein said heat-generating means are at least one of a radiator and a convector.

3. The heating installation according to claim 1, wherein said valve system further comprises:

a blocking valve connected to the feed/drain valve by a rod, wherein the blocking valve is loaded by a spring; and a screw cap rotatably connected to the spring.

* * * * *